US005732868A

United States Patent [19]

Gammon, Jr.

[11] Patent Number: 5,732,868

[45] Date of Patent: Mar. 31, 1998

[54] SYSTEM FOR SAFELY STORING AND DISPENSING A THIN SHEET-LIKE MATERIAL

[75] Inventor: Cole W. Gammon, Jr., Richmond, Va.

[73] Assignee: Reynolds Metals Company, Richmond, Va.

[21] Appl. No.: 230,279

[22] Filed: Apr. 20, 1994

[51] Int. Cl.[6] ..... B26F 3/02

[52] U.S. Cl. ..... 225/48; 225/50; 225/91

[58] Field of Search ..... 225/49, 48, 25, 225/50, 19, 91

[56] References Cited

U.S. PATENT DOCUMENTS

| | | | |
|---|---|---|---|
| 2,888,181 | 5/1959 | Lincoln et al. | 225/51 |
| 3,942,417 | 3/1976 | Finn | 93/49 M |
| 4,334,644 | 6/1982 | Hauser | 225/49 |
| 4,465,215 | 8/1984 | Kai | 225/48 |
| 4,648,536 | 3/1987 | VanderLugt | 225/43 |
| 4,651,911 | 3/1987 | Kirkup et al. | 225/48 |
| 4,666,072 | 5/1987 | McCarter | 225/48 |
| 4,679,718 | 7/1987 | Kai et al. | 225/48 |
| 5,454,750 | 10/1995 | Cosmano et al. | 451/533 |

FOREIGN PATENT DOCUMENTS

| | | | |
|---|---|---|---|
| 2-127242 | 5/1990 | Japan | 225/49 |

*Primary Examiner*—Kenneth E. Peterson
*Attorney, Agent, or Firm*—Alan T. McDonald

[57] ABSTRACT

A generally cubical cardboard container is provided for containing and storing a length of sheet-like material which may be drawn via an elongate slot in a top face of the container and over an uppermost edge portion of a front face of the container. A safe cutting element, preferably formed of a substrate bearing small sharp-edged particles, is adhered to the uppermost edge portion of the front face. A waterproof coating is provided to coat the sharp-edged particles, and protects them from any ambient moisture and/or grease and also ensures against removal of any particles during use. The user simply draws out a desired length of the sheet-like material through the slit and over the uppermost edge of the front face, and then applies a downward force to press the material to the sharp edges of the coated particles to initiate and continue a tear across the width of the material. A desired length of the material is thus detached and only a small portion of the remaining material remains exposed between the slit and the safe cutting element for subsequent access.

12 Claims, 3 Drawing Sheets

100
102
103
104
106
108
110
112
114
116
118
120
122
124
126
128
130
132
134
150
152
160
200
III
P
x
w
h

SYSTEM FOR SAFELY STORING AND DISPENSING A THIN SHEET-LIKE MATERIAL

FIELD OF THE INVENTION

This invention relates to a system for storing a length of thin sheet-like material from which desired lengths of the material may be drawn out and torn off by a user, and more particularly to such a system provided with a safe-to-use, durable, water and grease resistant cutting element for enabling a user to tear off the desired length without risk of accidently cutting his or her hands.

BACKGROUND OF THE PRIOR ART

There are numerous forms of thin sheet-like materials in common use in most households, establishments vending take-away meals, grocery stores, and the like. Such material may be a clear plastic, so that an item wrapped therein is visible (e.g., REYNOLON®), a thin aluminum foil (e.g., REYNOLDS WRAP®) in which people often wrap foods which are to be frozen for storage, plain or coated paper, or the like. Such sheet-like material typically is only a few thousandths of an inch in thickness, and is sold in widths ranging from about 10 inches to 24 inches. Other thicknesses and widths may also be encountered for particular uses. The material, whether plastic, metal foil, or paper, is typically stored in the form of a tightly wound roll over a cylindrical former which may be a hollow lightweight cardboard cylinder or a solid dowel rod.

Numerous systems exist for storing and dispensing such sheet-like materials. These typically have the form of a cubical cardboard box containing a roll of the material, with provision to enable a user to draw out and pull on the material to unwind it off the roll.

It was common to provide an elongate serrated metal strip upon which the drawn out sheet-like material was forcibly pressed by the user tugging at the drawn out material. The serrations, like saw teeth, would perforate the material and propagate a tear over the length of the serrated edge. When the user's hands are wet and softened, inadvertent contact between the serrated edge can cause abrasions, tears and cuts. Apart from the pain and inconvenience this may cause a user, at a time when there may be individuals who are seropositive (i.e., carriers of the HIV virus), there is a great desire to avoid such structures where persons handling food may suffer minor tears and bleed, sometimes without even being aware of it.

To avoid exposing the user to deliberately sharpened edges of metal, numerous suggestions have been made for providing such containers with an edge, a corner, or a surface on which are adhered small, hard, sharp-edged granules or particles. Such particles present a multitude of exposed sharp edges of small particles disposed in an elongate array much like a folded piece of sandpaper, to which the drawn out sheet-like material is forcibly pressed to initiate local perforations in the stressed material to initiate and complete the desired tear. Some examples of such known structures are discussed below.

U.S. Pat. No. 4,465,215 titled "Cutting Edge for Dispensing Container", to Kai, issued on Aug. 14, 1984, discloses a container in which short, corner or full-length surfaces are provided with "finely divided grindstone particles" adhered thereto. In the various embodiments taught in this patent the microscopically sharp corners of the grindstone particles are deliberately exposed to enhance their cutting ability. The container box of Kai has a folded but loosely disposed flap under and past which the sheet-like material is drawn over approximately the full width of one of the elongate sides to the exposed sharp edges of the tearing particle surface.

Other structures employing essentially the same principles as in Kai are taught in, for example, U.S. Pat. No. 3,942,417, titled "Dispenser Carton and Method of Manufacture", to Finn (issued Mar. 9, 1976) and U.S. Pat. No. 2,888,181, titled "Dispensing Container for Sheet Material", to Lincoln et al. (issued Apr. 5, 1956).

Another problem arises in using such devices—namely that a length of the sheet-like material remains exposed to ambient dirt after a piece is torn off, and this portion occasionally falls back into the container if the roll inside moves. U.S. Pat. No. 4,648,536, titled "Carton for Dispensing Sheet Material in Roll Form," to VenderLugt, issued on Mar. 10, 1987, teaches the provision of a tacky surface on a flap to hold the exposed end of the material.

Per the teaching of the above-identified references, and others like them, a few inches of the sheet-like material remains exposed to ambient moisture, dirt and other pollutants after the user has torn off the desired length. Where this happens, e.g., in a sandwich shop, the exposed portion may collect smells, flavors, air-borne dust and pollutants or the like, and these may become transferred to a sandwich or other item of food wrapped in the next piece of material drawn out from the container.

Also, in homes and in the kitchens of food-vending establishments, moisture and/or grease may be transferred from a user's hand to the particle-bearing cutting surface, or the cardboard container may become wet or grease-splattered if the user places it too close to a sink, a frying pan or the like. These are frequently encountered, and sometimes unavoidable, circumstances of normal use. When the cardboard beneath and around the particle-bearing surface becomes wet or grease-impregnated, there may be a tendency for the particles to become individually released when pressed by the sheet-like material being torn thereby. In the presence of moisture and/or grease, the detached particles tend to cling to the torn off length of sheet-like material and may thus be transferred to the item of food being wrapped therein. Anyone who has chewed on a piece of grit will readily appreciate that the experience is very unpleasant and may cause damage to teeth.

There is, therefore, an existing need for a system to dispense sheet-like material which will permit a user to draw out and safely tear off a desired length, which leaves only a minimal portion of the remaining sheet-like material exposed for easy subsequent access to the sheet-like material, and which ensures against the release of individual, hard, sharp-edged particles in the presence of ambient moisture and/or grease at the location of use. These and other related objects are easily and economically realized by the invention described below with reference to the accompanying drawing figures.

SUMMARY OF THE INVENTION

It is a principal object of the present invention to provide a system for storing a length of sheet-like material, which allows a user to draw out and safely tear off a desired length of the material, and permits the user to readily access the remaining material without exposing undue amounts of the same to ambient dirt, moisture and air-borne pollutants.

It is yet another object of this invention to provide a container for storing and safely dispensing a length of sheet-like material by enabling a user to tear off the desired lengths at a surface on which small sharp-edged particles are disposed, while ensuring that sharp-edged particles do not become detached in normal use even in the presence of moisture and/or grease.

These and other related objectives are realized by providing a system for storing a length of sheet-like material of selected width, for safely dispensing desired lengths thereof, and for holding a short length of the material exposed for subsequent access thereto, the system including an elongate container which is sized and shaped to loosely contained therein a stored length of material. The container has a first face, and a second face adjacent thereto which is formed to have a narrow longitudinal opening. A safe cutting element is provided along an edge of the first face so as to be parallel to and spaced from the opening in the second face by a distance which is less than a width of the second face. This structure permits a user to draw out the sheet material via the opening until the desired length thereof extends past the safe cutting element. The user then forces the sheet material against the safe cutting element to tear off the desired length. This leaves exposed for subsequent access, over the second face, a length of the sheet material extending between the opening and the safe cutting element.

DETAILED DESCRIPTION OF THE PREFERRED EMBODIMENTS

Figures 1, 2, 3, 4:
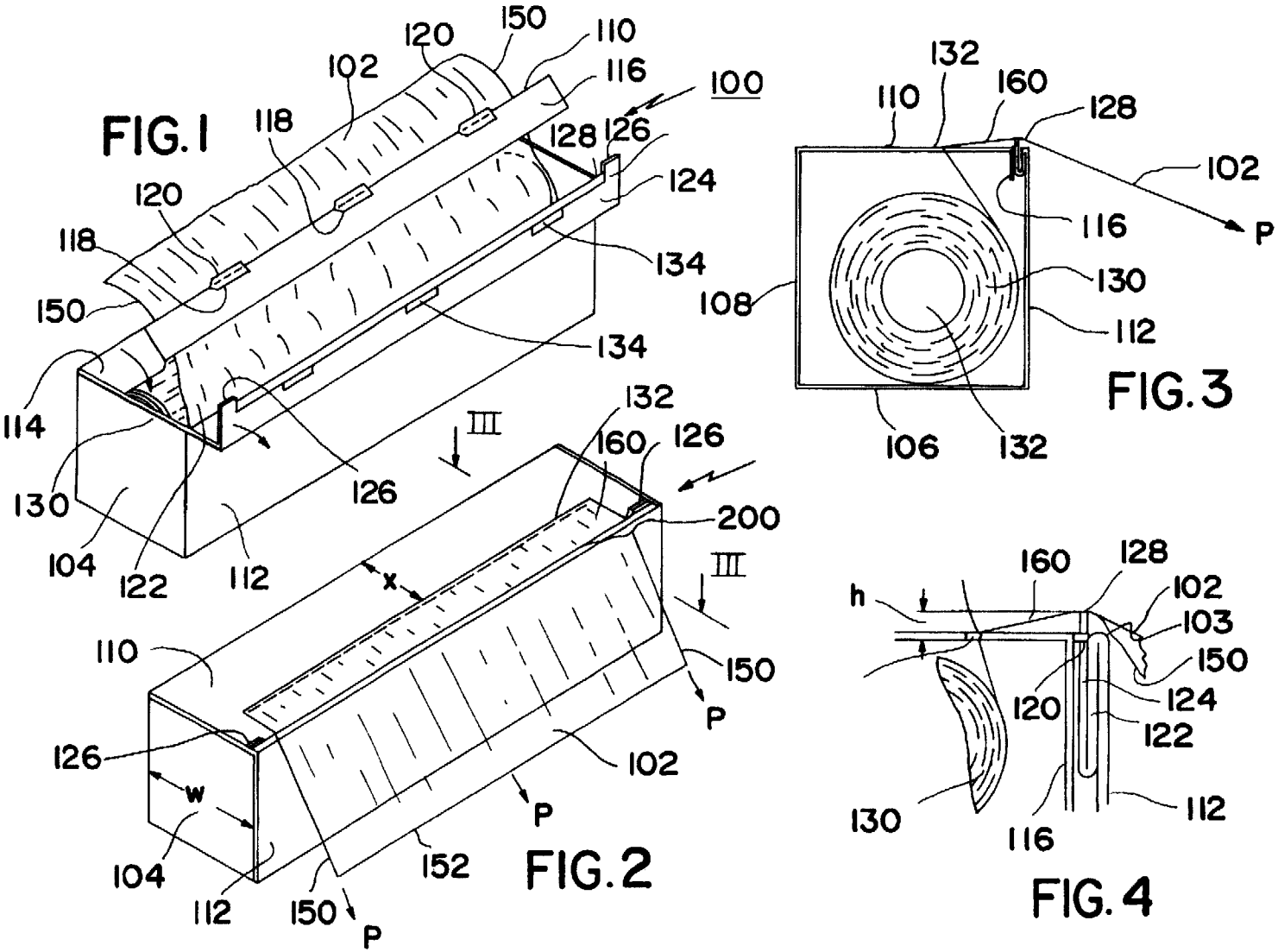
FIG. 1 is a perspective view of a system according to a preferred embodiment of this system, wherein the container is shown opened to illustrate certain details.
FIG. 2 is a perspective view of the system according to the preferred embodiment of FIG. 1, in a disposition for use.
FIG. 3 is a transverse cross-sectional view at Section III—III per FIG. 2.
FIG. 4 is an enlarged cross-sectional view corresponding to a portion of the structure per FIG. 3, to clarify certain details of the structure adjacent the safe cutting element.

As best seen in FIG. 1, the preferred embodiment of the invention comprises a generally cubical box or container 100, conveniently made of cardboard of a thickness suitable for the intended circumstances of use. Thus, where a relatively small width and length of sheet-like material 102 is to be stored and dispensed, container 100 may be made of a relatively thin cardboard, whereas for storing and dispensing from a relatively long length (e.g., 500–3,000 ft.) and of a substantial width (e.g., 24–40 in.), it may be preferable to make container 100 of a stiff and thick cardboard. The external surface of container 100 may be plastic-coated, or otherwise treated to minimize soaking thereinto of ambient moisture, grease, odors, or the like.

Typically, container 100 is made by folding a single precut piece of cardboard, wherein fold lines are defined by pressing or scoring the cardboard at selected locations. The exact way in which this is accomplished is considered to be a matter of design choice. In the embodiment per FIG. 1, container 100 has two substantially square end faces 104 (only one seen in FIG. 1), a bottom face 106, a back face 108 (best seen in the cross-sectional view per FIG. 3), a top face 110, and a front face 112. Top face 110 is formed to have contiguous therewith side flaps 114 at each end (only one readily seen in FIG. 1) and a front flap 116, these flaps being folded to depend inwardly of the interior of the container in use. One or more small cuts are provided in the front flap 116 such that when front flap 116 is folded as shown, small openings 118 and corresponding small extension flaps 120 contiguous with top surface 110 are defined. The latter extend outwardly toward the front face 112.

Front face 112 is formed to extend past the upper edges of end faces 104, but is folded as best understood with reference to FIGS. 3 and 4, so as to have two folds disposed in a "S"-shaped manner. Thus, as best understood with reference to FIG. 4, the uppermost portion of front face 112 is folded once to generate an inward and downward fold 122 and, contiguous therewith, a second parallel upward fold 124. This upwardly and outwardly oriented fold 124 ends in a terminal edge which is preferably shaped in somewhat notched manner so as to have two upward end extensions 126, 126 between which is provided an elongate terminal edge portion of front face 112 along and over which is provided the safe cutting element 128.

Inside container 100 is stored a roll 130 of the thin sheet-like material 102, tightly wound over a central elongate former 132 which may be solid or hollowed and made of any suitable material, e.g., a cardboard cylinder, a wooden dowel, or even a cylindrical piece of foam.

Top face 110 is formed to have a narrow elongate slit 132 which is a little wider than the thickness of the sheet-like material 102 and is a little longer than the overall width of the sheet-like material 102. This facilitates drawing out of the sheet-like material 102 through slit 132 by a generally upward pull by the user, this causing roll 130 to rotate in its loose confinement within container 100 to release more of the material 102. Container 100 is made so that its width is "w" as best seen in FIG. 2, and slit 132 is formed to be parallel to the front face 112 and is located at a distance "x" relative to the back face 108.

Flap 124 of front face 112 is formed to have a number of apertures 134 which are shaped, sized and located to receive therein respective extension flaps 120 of top face 110. Corresponding apertures may also be provided in flap 122. Thus, when container 100 is put in its final, in-use, disposition (per FIG. 2) each extension flap 120 projects through and is held in a corresponding aperture 134 to maintain such engagement of top face 110 to the front face 112. Extension flaps 134 may also extend into the cooperating apertures in flap 122 if such are provided.

Figure 7:
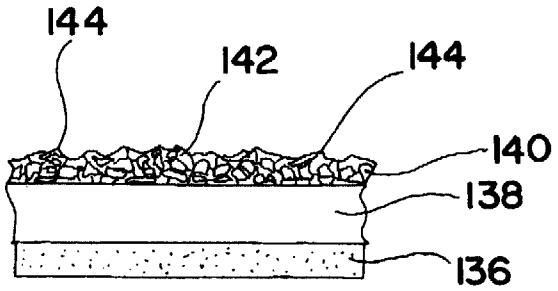
FIG. 7 is a transverse cross-sectional view across a thickness of an adhesive-backed substrate element supporting coated, sharp-edged particles in the safe cutting element structure according to the preferred embodiments.

The safe cutting element 128, according to the preferred embodiments, is initially most conveniently obtained in the form of a flexible strip. An example of commercially available material for this purpose is "Mineral Grit, No-Slip, Safety Top #263", from Myro, Inc., of Milwaukee, Wis. As best seen in the cross-sectional view per FIG. 7, such a safe cutting element 128 comprises an adhesive layer 136 applied to one side of a substrate 138, and a layer 140 comprising a plurality of small but sharp-edged hard particles adhered by any suitable adhesive to an opposite side of substrate 138. Such particles may be made of any known hard, particulate material, e.g., mineral grit such as sand, various silicates, and the like. Likewise, the adhesive material used to adhere the particles to substrate 138 may also be of any known type, but is preferably a material which is inherently waterproof. However, according to the preferred embodiments, to ensure against damage due to incidental reception of water and/or grease by the safe cutting element 128, a thin waterproof coating 142 is provided to cover the particle layer 140. This coating may be made of a tough plastics material which itself becomes relatively hard after its application to the sharp-edged particles. A variety of commercially-available acrylic materials are suitable for this surface, but coating 142 may be made of any other known material or combination of materials. By keeping coating 142 relatively thin, it is possible to ensure that the sharp edges and points of the underlying particles generate a very closely corresponding plurality of sharp edges and points 144 at the exposed surface of coating 142, to serve as local stress-raisers in the sheet-like material 102 forcibly pressed thereto.

Figure 6:
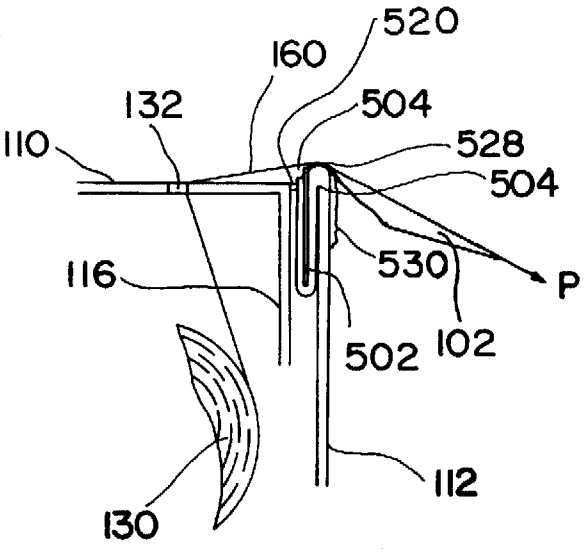
FIG. 6 is an enlarged transverse cross-sectional view of a portion of the structure per FIG. 5, taken at Section VI—VI in FIG. 5, to clarify certain structural details of the system adjacent the safe cutting element thereof.
Figure 5:
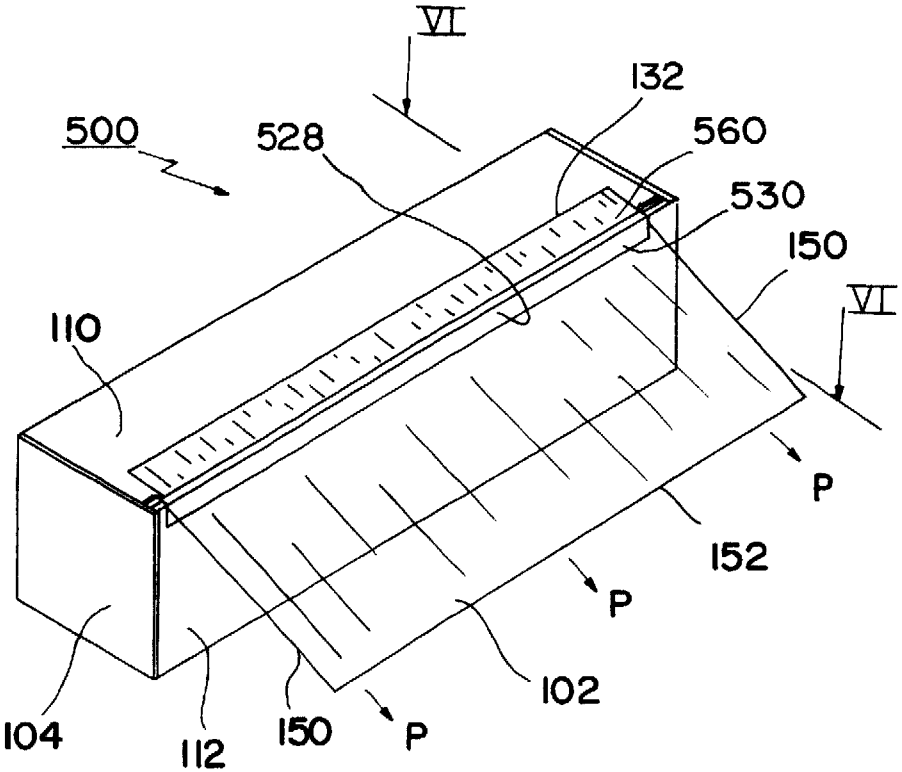
FIG. 5 is a perspective of another preferred embodiment of the invention, in an in-use disposition thereof.

A second preferred embodiment is illustrated in FIGS. 5 and 6. In this embodiment, container 500 is largely similar to container 100, except for certain structural and dispositional differences at and about the uppermost portion of front face 110. Note that the same numerals are utilized in describing and referring to structural elements of both embodiments to the extent possible. In this second embodiment the front face 112 is provided a first longitudinal crease slightly above the level of top face 110 (in its in-use disposition) to create a first inward and downward fold 502, thereby defining an uppermost folded edge 504. Fold 502 is folded again to generate an upward and outwardly oriented innermost fold 504 which preferably extends to just below top surface 110. As with the first embodiment, inside container 500 there is provided a roll 130 of the thin sheet-like stored material from which a desired length 102 is drawn via slit 132 in top face 110 and over and above the top of front face 112.

In the second embodiment, as best seen in FIG. 6, the safe cutting element 528 is adhered to at least the top of the upper longitudinal folded edge 504 and may also have a portion 530 adhered to the uppermost outside surface of front face 112. The goal, as in the first embodiment, is to ensure that there is enough adherence, by adhesive 136, between substrate 138 and the corresponding surfaces of face 112. Cuts like cuts 118 may be formed in flap 116 of top face 110 to generate outward extensions 520 like 120 of the first embodiment, and corresponding apertures like apertures 134 may be formed at least in inside fold 504, and also in fold 502 if desired, to facilitate retention of top face 110 to front face 112 in the container 500.

Other structural details are generally similar for the two embodiments, and the manner of their use is also generally similar, as more fully described below.

To use the first embodiment, the user first projects the extreme end portion of sheet-like material 102 through slit 132 via uplifted top face 110, e.g., per FIG. 1, and then pushes top face down until the extended flaps 120 are engaged into apertures 134 at the top of front face 112. Further drawing out of sheet-like material 102 is best accomplished by the user grabbing the same at or about the corners near outside edges 150,150. In the alternative, the user may grab the extreme end portion of sheet-like material 102 at about the middle of its distal end edge 52. The process is generally the same for the second embodiment. The application of such a pulling force is indicated by arrows identified by the letter "P" in FIGS. 2, 3, 5 and 6.

Once a desired length of the sheet-like material 102 has been pulled over the safe cutting element 128 or 528 by directing a lifting and outwardly pulling force, the user must change the direction of the force so that the sheet-like material 102 is pressed downwardly to the sharp edges and points defined in coating 142 of the safe cutting element. This generates local stressing, then stretching, and ultimately perforation of the thin sheet-like material 102 at and over such elongately distributed sharp edges and points. As the user continues to apply the force "P" the material tears to form a torn edge, e.g., 200 as best seen in FIG. 2, which propagates along the length of the safe cutting element. Eventually this releases the torn off desired length of the sheet-like material 102.

For the structures per both of the preferred embodiments discussed above, it is found that with most of the common sheet-like materials, e.g., PVC or other plastics-material thin films, enough of the sheet-like material remains locally hooked to some of the points and edges so that it remains stretched between slit 132 and the safe cutting element 128 (or 528) as best seen in FIGS. 2 and 5. This small exposed portion of the sheet-like material, 160 in FIG. 2 and 560 in FIG. 5, has a much smaller length-wise span than the lengths of exposed materials left by the structures taught in the above-discussed prior art. Also, these portions 160 (or 560) of the sheet-like material 102 remain readily accessible for future drawing out by the user. In short, while leaving only the short length "w–x" slightly raised at its front edge where it is hooked over the safe cutting element, either embodiment minimizes the contaminated area of the stored sheet while making it extremely convenient for a user to draw more sheet-like material as needed. If the drawn out material comprises a malleable metal foil, the exposed length "w–x" thereof remains bent at slit 132 and extends therefrom to the safe cutting element 128 for later access.

Finally, it should be appreciated that downward flap 116 of top face 110, in each embodiment, is disposed essentially parallel to and in a pressing relationship with respect to the innermost fold of front face 112, i.e., 124 in the first embodiment or 504 in the second embodiment. This ensures against ingress of external dirt into the interior of container 100 or 500. Slit 132 is made relatively narrow, e.g., between 1/16 and 1/8 inch in width, this also ensures that ingress of external dirt into the interior of the container is minimized. Furthermore, note that the repeated folding of the uppermost portion of front face 112 creates a relatively stiff region at which the safe cutting element is adhered. In the first embodiment the forwardmost surface of flap 116 pressing against the upward fold 124 assists in stiffening this region over which the drawn out material is pressed to be cut. In the second embodiment, the particles are disposed over the folded portion and topmost folded edge of front face 112, whereby the desired stiffening is also inherently obtained. This ensures added structural strength where forcible interaction is caused between the drawn out material 102 and the safe cutting element 128 in each embodiment.

Because coating 142 is deliberately selected to be of a waterproof material, e.g., a plastics or acrylic material, even when the user's hands are wet or greasy repeated touching of coating 142 will not cause the moisture and/or grease to impregnate into substrate 138. This ensures against weakening of the bonding between the individual particles and the upper surface of substrate 138. Likewise it minimizes absorption of moisture or grease by the cardboard material of front face 112 at and near the safe cutting element 128. Any moisture that accidentally contacts coating 142 will either dry up or drip away from the uppermost edge portion of front face 112, and will, therefore, not weaken the same.

Figure 8:
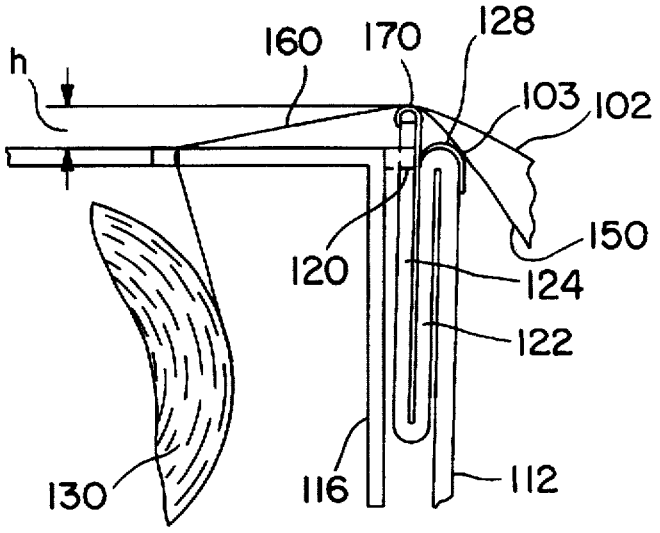
FIG. 8 is an enlarged cross-sectional view, similar to FIG. 4, illustrating the use of a plastic film retaining means adjacent to the safe cutting element.

As a further alternative, in order that additional gripping of the plastic film material 102 may occur, a modification of the FIGS. 1–4 embodiment is possible, as shown in FIG. 8. In this alternative, the safe cutting element 128 is moved from its position on upward fold 124 to a portion of the S-fold 103. At the location on upward fold 124 where the safe cutting element was located, a plastic strip 170, which may be in the form of a tape or coating, is positioned. This plastic strip, which may be formed of any suitable plastic material, causes the plastic film material 102 to cling to it during and after cutting, aiding both in providing a clean cut and in retaining the end portion of the plastic film material 102 after cutting.

As will be appreciated, persons of ordinary skill in the art can be expected to consider obvious variations and modifications of the invention and preferred embodiments as disclosed herein in detail. All such modifications are considered to be comprehended within the present invention which is limited solely by the claims appended hereto.

What is claimed is:

1. A system for storing a length of sheet material of a selected width, said sheet material being in the form of a plastic film, for safely dispensing desired lengths thereof, and for holding a short length of the sheet material exposed for subsequent access thereto, comprising:

an elongate container sized and shaped to loosely contain therein a stored length of the sheet material, the container having a first face and a second face adjacent thereto, the second face being formed to have a narrow longitudinal opening; and a safe cutting element provided along an edge of the first face parallel to and spaced from the opening by a distance less than a width of the second face and having a longitudinal length at least substantially equal to the selected width of the sheet material, whereby a user may draw out the sheet material via the opening until a desired length of the sheet material extends past the safe cutting element and then force the sheet material against the safe cutting element to tear off the desired length while leaving exposed over the second face a length of the sheet material extended over the distance between the opening and the safe cutting element, wherein said safe cutting element comprises a plurality of rough-edged particles attached to a substrate, a second surface of the substrate being disposed over the terminal edge of the first face and adhered to opposite surfaces of an edge portion of the first face, and wherein a waterproof coating is provided over the rough-edged particles to a thickness sufficient to prevent individual rough-edged particles from becoming detached from the substrate when the sheet material is forcibly pressed thereto yet thin enough and sufficiently hard to allow coated rough edges and points of the rough-edged particles to stress the forcibly pressed sheet material enough to cause tearing across the entire width thereof and to permit the coated rough edges and points of the rough-edged particles to retain the exposed edge of the sheet material against the safe cutting element after cutting.

2. The system according to claim 1, wherein:

the first face is folded in a first fold parallel to the second face and a second fold parallel to the first fold such that the terminal edge is located no lower than the second face and the first fold.

3. The system according to claim 2, wherein:

the second face is formed to have a flap-fold extending parallel to the opening and defining a flap which, in use, is disposed toward an interior of the container and against the edge portion of the folded first face.

4. The system according to claim 3, wherein:

the flap of the second face is provided with cuts to define corresponding coplanar extensions of the second face extending beyond the flap; and the first and second folds of the first face are formed to have respective apertures shaped, sized and disposed to receive the extensions of the second face and to thereby specifically locate the second face relative to the first face and the safe cutting element.

5. The system according to claim 1, wherein:

the first face is folded to define a folded edge parallel to the second face; and the rough-edged particles are attached to a first surface of a substrate, a second surface of the substrate being disposed over and adhered to the folded edge of the first face and to an edge portion of the first face adjacent the folded edge.

6. The system according to claim 5, wherein:

a waterproof coating is provided over the rough-edged particles to a thickness sufficient to prevent individual rough-edged particles from becoming detached from the substrate when the sheet material is forcibly pressed thereto yet thin enough to allow coated rough edges and points of the rough-edged particles to stress the forcibly pressed sheet material enough to cause tearing thereof.

7. The container according to claim 6, wherein:

the folded edge is located so that the rough-edged particles disposed thereover are located no lower than the second face.

8. The system according to claim 7, wherein:

the second face is formed to have a flap-fold extending parallel to the opening and defining a flap which, in use, is disposed toward an interior of the container and against the first face adjacent the folded edge thereof.

9. The system according to claim 7, wherein:

the flap of the second face is provided with cuts to define corresponding coplanar extensions of the second face extending beyond the flap; and the first face is formed to have apertures along the folded edge and shaped, sized and disposed to receive the extensions of the second face and to thereby specifically locate the second face relative to the first face and the safe cutting element.

10. The system according to claim 1, wherein:

a plastic strip is positioned between the safe cutting element and the opening to provide a clinging surface for the sheet material.

11. A system for storing a length of sheet material of a selected width, said sheet material being in the form of a plastic film, for safely dispensing desired lengths thereof, and for holding a short length of the sheet material exposed for subsequent access thereto, comprising:

an elongate container sized and shaped to contain therein a stored length of the sheet material, the container having a first face and a second face adjacent thereto, the second face being formed to have a narrow longitudinal opening; and a safe cutting element provided along an edge of the first face parallel to and spaced from the opening by a distance less than a width of the second face, and having a longitudinal length at least substantially equal to the selected width of the sheet material.

whereby a user may draw out the sheet material via the opening until a desired length of the sheet material extends past the safe cutting element and then force the sheet material against the safe cutting element to tear off the desired length while leaving exposed over the second face a length of the sheet material extended over the distance between the opening and the safe cutting element, wherein the safe cutting element comprises a plurality of rough-edged particles attached over and along a terminal edge of the first face, the rough-edged particles being attached to a first surface of a substrate, a second surface of the substrate being disposed over the terminal edge of the first face and adhered to opposite surfaces of an edge portion of the first face, with a waterproof coating provided over the rough-edged particles to a thickness sufficient to prevent individual rough-edged particles from becoming detached from the substrate when the sheet material is forcibly pressed thereto yet thin enough and sufficiently hard to allow coated rough edges and points of the rough-edged particles to stress the forcibly pressed sheet material enough to cause tearing across the entire width thereof and to permit the coated rough edges and points of the rough-edged particles to retain the exposed edge of the sheet material against the safe cutting element after cutting, wherein the first face is folded in a first fold parallel to the second face and in a second fold parallel to the first fold such that the terminal edge is located no lower than the second face and the first fold, and the second face is formed to have a flap-fold extending parallel to the opening and defining a flap which in use is disposed toward an interior of the container and against the edge portion of the folded first face, the flap of the second face being provided with a plurality of cuts to define corresponding coplanar extensions of the second face extending beyond the flap, and the first and second folds of the first face are formed to have respective apertures shaped, sized and disposed to receive the extensions of the second face and to thereby specifically locate the second face relative to the first face and the safe cutting element provided thereon.

12. A system for storing a length of sheet material of a selected width, said sheet material being in the form of a plastic film, for safely dispensing desired lengths thereof, and for holding a short length of the sheet material exposed for subsequent access thereto, comprising:

an elongate container sized and shaped to loosely contain therein a stored length of the sheet material, the container having a first face and a second face adjacent thereto, the second face being formed to have a narrow longitudinal opening; and a safe cutting element provided along an edge of the first face parallel to and spaced from the opening by a distance less than a width of the second face, and having a longitudinal length at least substantially equal to the selected width of the sheet material, whereby a user may draw out the sheet material via the opening until a desired length of the sheet material extends past the safe cutting element and then force the sheet material against the safe cutting element to tear off the desired length while leaving exposed over the second face a length of the sheet material extended over the distance between the opening and the safe cutting element, wherein the first face is folded to define a folded edge parallel to the second face and the second face is formed to have a flap-fold extending parallel to the opening and defining a flap which in use is disposed toward an interior of the container and against the first face adjacent the folded edge thereof, the flap of the second face being provided with cuts to define corresponding coplanar extensions of the second face extending beyond the flap and the first face being formed to have apertures along the folded edge and shaped, sized and disposed to receive the extensions of the second face and to thereby specifically locate the second face relative to the first face and the safe cutting element provided thereon, and wherein the safe cutting element comprises a plurality of rough-edged particles attached over and along a terminal edge of the first face, the rough-edged particles are being attached to a first surface of a substrate, a second surface of the substrate being disposed over and adhered to the folded edge of the first face and to an edge portion of the first face adjacent the folded edge, and a waterproof coating is provided over the rough-edged particles to a thickness sufficient to prevent individual rough-edged particles from becoming detached from the substrate yet thin enough and sufficiently hard to allow coated rough edges and points of the rough-edged particles to stress the forcibly pressed sheet material enough to cause tearing across the entire width thereof and to permit the coated rough edges and points of the rough-edged particles to retain the exposed edge of the sheet material against the safe cutting element after cutting.

* * * * *